United States Patent [19]

Klosk

[11] 4,126,241

[45] Nov. 21, 1978

[54] RUBBISH RECEPTACLE

[76] Inventor: Lawrence Klosk, 3977 Sedgwick Ave., Bronx, N.Y. 10463

[21] Appl. No.: 609,703

[22] Filed: Sep. 2, 1975

[51] Int. Cl.[2] ..... B65D 51/04

[52] U.S. Cl. ..... 220/1 T; 220/334

[58] Field of Search ..... 220/1 T, 18, 334, 4 R; 232/43.1, 43.2, 43.4

[56] References Cited

U.S. PATENT DOCUMENTS

| | | | |
|---|---|---|---|
| 1,831,687 | 11/1931 | Ross | 220/4 R X |
| 1,964,513 | 6/1934 | Hammer | 220/334 X |
| 3,096,900 | 7/1963 | Breneman | 220/334 X |
| 3,394,832 | 7/1968 | McAllister, Jr. et al. | 220/1 T |

*Primary Examiner*—William Price
*Assistant Examiner*—Steven M. Pollard
*Attorney, Agent, or Firm*—James & Franklin

[57] ABSTRACT

The receptacle includes a housing adapted to receive rubbish or the like with opposite walls each having an opening through which rubbish may be inserted into the housing. Doors are articulately mounted on each side of the housing and each is independently movable between a vertical position substantially closing the opening and a second position exposing the opening. An element is mounted on each door and extends therefrom into the housing. The element is so positioned with respect to the door and the housing such that when the door is in the second position, the element engages the housing and prevents further inward movement of the door beyond the second position. The element also biases the door towards the closed position, regardless of the position of the door, thereby tending to keep the door closed when rubbish is not being inserted. Cooperating positive stop means on each door and the housing, respectively, are effective to prevent the door from swinging outwardly of the housing. This feature prevents rubbish from passing outwardly through the door on one side of the housing as it is being inserted through the door on the other side of the housing. In addition, since each door is retained in the closed position by the element, thus forming a seal between the lip and wall, a fire within the receptacle tends to be smothered for lack of oxygen. The doors are extra long to permit larger articles of rubbish to be inserted in the receptacle. In addition, the receptacle has inclined top surfaces to prevent rubbish from being placed thereon.

15 Claims, 5 Drawing Figures

RUBBISH RECEPTACLE

The present invention relates to rubbish receptacles an in particular, rubbish receptacles of relatively large capacity suitable for use in areas of public access.

Conventional high capacity rubbish receptacles designed for use in public areas such as subway stations, recreation facilities and the like are often provided with a triangular shaped rubbish entrance portion which is mounted on a box-like rubbish retaining portion having an opening on the top surface thereof. The rubbish entrance portion is provided with a pair of spring loaded doors or an inverted "V" shaped door assembly. In either case, the doors are pivotally mounted near the top of the inclined wall forming the triangular rubbish entrance portion. The rubbish entrance portion has openings on either side thereof such that the doors, because of their structure or the spring loading thereof, normally close both openings. However, when rubbish is inserted through one of the openings, the door in that opening may be pushed inwardly to an extent such that the door on the other opening will be pushed outwardly beyond the physical confines of the rubbish entrance portion.

This construction, therefore, has a drawback in that when the rubbish retaining portion is nearly full to capacity, the insertion of additional rubbish through the opening on one side of the rubbish retaining portion may permit some of the rubbish to be pushed out through the opposite side of the receptacle. This occurs because the door on the opposite side may swing outwardly beyond the confines of the housing as rubbish is being inserted on the other side thereby permitting rubbish to fall or be pushed out. In addition, due to the incline of the wall to which the door is mounted, the arc defined by the lower edge of the door passes downwardly into the rubbish receptacle portion. Thus, the movement of the door in and of itself may be sufficient to push rubbish outwardly through one of the openings.

Further, when rubbish is inserted into the receptacle, it may be compressed. Thereafter, certain rubbish, for instance, crumpled paper, has a tendency to expand, thus causing the top pieces of rubbish, when the retainer is filled close to capacity, to extend into the area of the arc defined by the movement of the doors. Therefore, any movement of the doors will tend to push this top rubbish from the receptacle.

It is advantageous to have the inner confines of the receptacle as isolated as possible from the outside atmosphere. If a fire should occur within the receptacle, such as by the careless placement of a lit cigarette therein, the fire will tend to be automatically smothered for lack of oxygen. However, in the receptacle design described above, a substantially air-tight seal between the doors and the respective openings is not possible because the doors must be capable of freely swinging both inwardly and outwardly of each opening. Even when the doors are in the closed position, a relatively large gap exists between the edge of the door and the edge of the adjacent housing. This permits oxygen to enter the receptacle and feed the fire.

It is, therefore, a prime object of the present invention to provide a rubbish receptacle having independently mounted doors such that the inward swinging of one door does not cause the outward swinging of the other door thereby permitting rubbish to fall out of the opening of the outward swinging door.

It is a second object of the present invention to provide a rubbish receptacle wherein the arc defined by the inward movement of the door does not extend downwardly into the rubbish retaining portion of the receptacle thereby causing rubbish to be pushed out of the receptacle by the movement of the door.

It is a third object of the present invention to provide a rubbish receptacle having means for urging each of the doors towards its closed position and wherein the same means is utilized to limit the inward movement of the door.

It is another object of the present invention to provide a rubbish receptacle wherein the door is provided with a lip for preventing the outward movement of the door beyond the confines of the rubbish entrance portion and, in addition, providing a seal between the door and the opening when the door is in the closed position.

It is a further object of the present invention to provide a rubbish receptacle which tends to smother fires therein by preventing oxygen from entering the housing when the doors are in the closed position.

It is still another object of the present invention to provide a rubbish receptacle with an extra large door permitting the ingress of larger items of rubbish.

It is a still further object of the present invention to provide a rubbish receptacle wherein the top surface thereof is inclined to prevent the placement of rubbish thereon.

To these and other objects as may hereinafter appear, the present invention relates to a rubbish receptacle as defined in the appended claims and set forth in the specification, taken together with the accompanying drawings wherein like numerals refer to like parts and in which:

Figure 1:
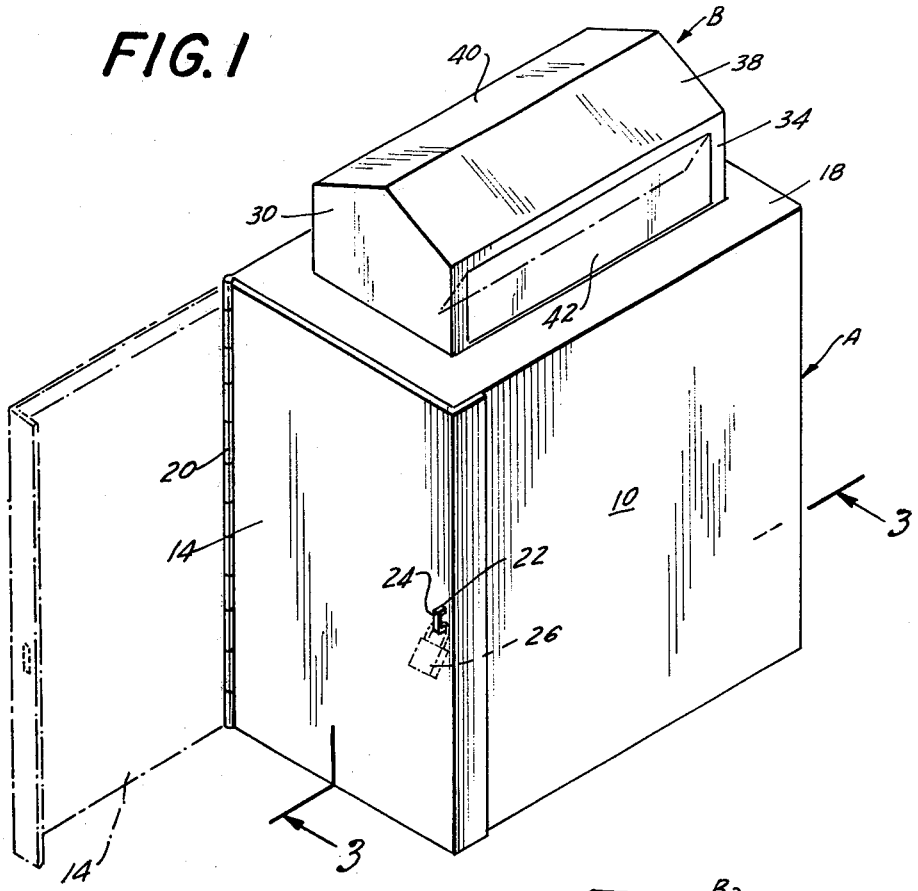
FIG. 1 is an isometric view showing the front and one side of the rubbish receptacle of the present invention.
Figure 2:
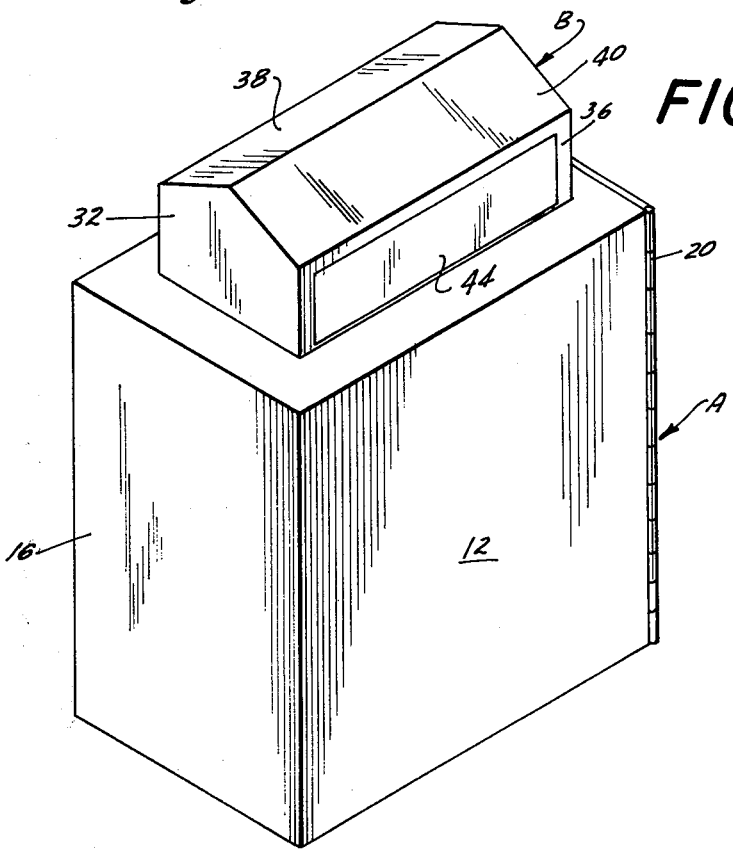
FIG. 2 is an isometric view showing the back and the other side of the rubbish receptacle of the present invention.
Figure 3:
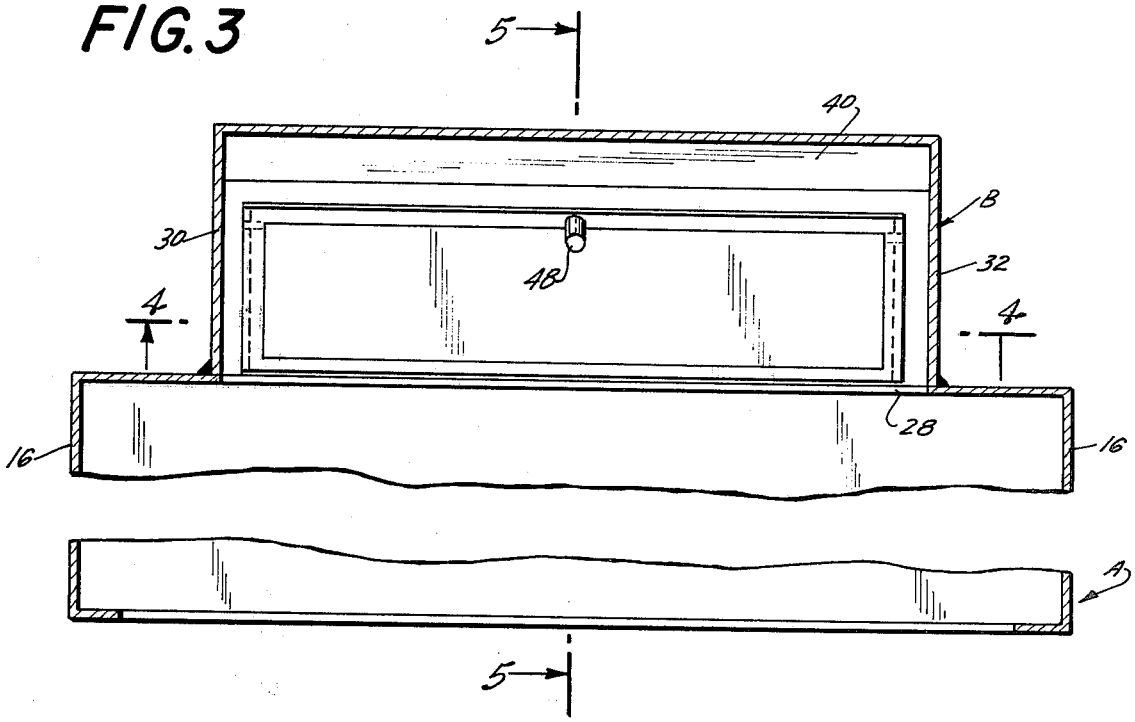
FIG. 3 is a view taken along line 3—3 of FIG. 1.

As seen in FIGS. 1 and 2, the rubbish receptacle of the present invention comprises a box-like rubbish retaining portion, generally designated A. Rubbish retaining portion A is hollow and the top surface thereof is provided with a rubbish ingress aperture over which a rubbish entrance portion, generally designated B, is situated. Rubbish entrance portion B is hollow and is provided with an opening on each side thereof to permit the insertion of rubbish into the interior of the rubbish entrance portion B such that it may pass through the rubbish ingress aperture on the top surface of the rubbish retaining portion A.

Rubbish retaining portion A comprises a front panel 10, a rear panel 12, a door side 14 and a fixed side 16, as well as a top surface 18 and a bottom surface (not shown). These six walls joined in box-like fashion produce an enclosed depository for rubbish. Door side 14 is connected to rear wall 12 by means of a hinge 20 such that the door side 14 may be moved from the closed position (shown in solid in FIG. 1) to the open position (shown in phantom in FIG. 1) thus enabling the contents of the rubbish retaining portion A to be conveniently removed. Door side 14 is provided with an aperture 22 through which a latch 24 extends when the door is in the closed position. Latch 24 is utilized to support a lock 26 to prevent opening of the door side by unauthorized persons.

The top surface 18 of rubbish entrance portion A is provided with a rubbish ingress aperture 28 through which rubbish is deposited into rubbish retaining portion A. Rubbish entrance portion B is preferably welded to top surface 18 such that the rubbish ingress aperture 28 is completely covered. Rubbish entrance portion B comprises side walls 30 and 32, front wall 34 and rear wall 36, all of which are substantially vertical. Side walls 30 and 32 have tapered upper portions such that the surfaces 38 and 40 mounted to the top of the rubbish entrance portion B are inclined towards front wall 34 and rear wall 36, respectively, in roof-like fashion.

Front wall 34 is provided with a door 42 which is pivotally connected thereto. In a similar manner, rear wall 36 is provided with a door 44 which is pivotally connected thereto. Doors 42 and 44 are independently movable with respect to the rubbish entrance portion B and each other.

Figure 4:
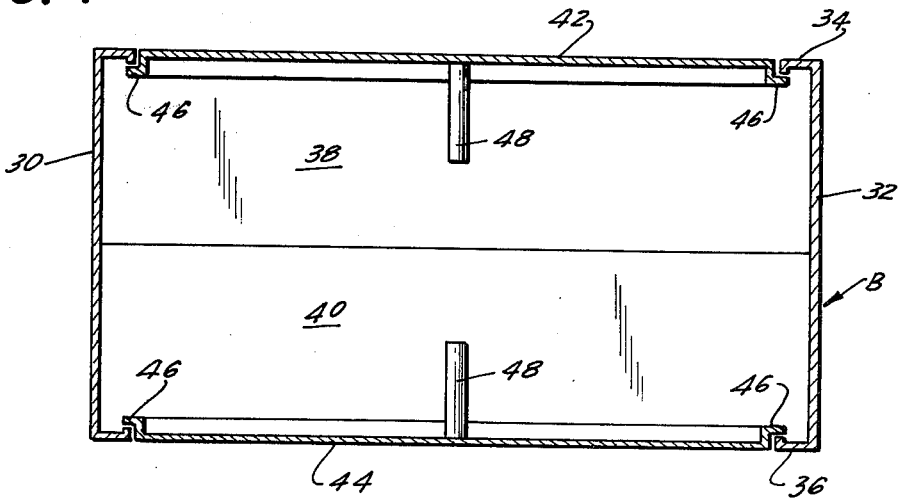
FIG. 4 is a view taken along line 4—4 of FIG. 3.

As best seen in FIG. 4, each of the doors 42 and 44 is provided with a lip 46 which extends outwardly beyond the peripheral edges of the door behind the edge of the wall adjacent thereto such that the doors are prevented from swinging outwardly beyond the plane of the wall to which they are mounted. Doors 42 and 44 are, however, free to swing inwardly towards the interior of the rubbish entrance portion. This construction prevents rubbish from being pushed outwardly through one door as additional rubbish is being inserted through the other door. In addition, lip 46 serves as a relatively effective seal between the interior of the rubbish entrance portion and the exterior of the receptacle when the doors are in the closed position. This tends to smother any fire which may have been carelessly started within the receptacle by a lit cigarette or the like.

Figure 5:
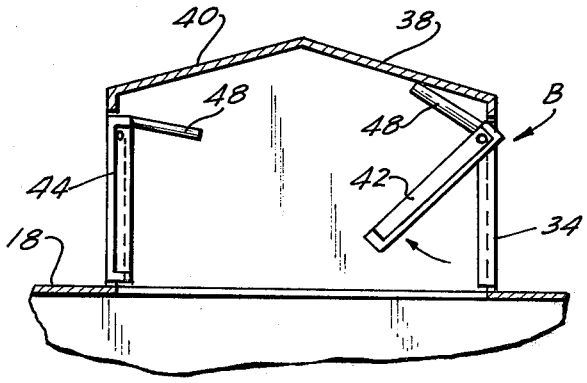
FIG. 5 is a view taken along line 5—5 of FIG. 3.

Each of the doors is held in its vertical closed position by means of a rigid elongated element 48 which extends inwardly from the door adjacent the portion thereof pivotally mounted to the wall. The weight of element 48, which can be made of any suitable material, urges the door to which it is attached towards its vertical or closed position. In addition, when the door is opened to insert rubbish (as is door 42 in FIG. 5), element 48 engages the inner surface of the top of rubbish engrance portion B (in this case surface 38), thereby preventing the door from moving inwardly beyond the maximum inward position. Thus, element 48 acts both to urge the door toward the closed position and as a means of limiting the inward movement of the door.

This construction prevents rubbish in the rubbish retaining portion A from being pushed out of one door as additional rubbish is pushed in through the other door. This is because the door cannot swing outwardly because of lip 46 and is urged towards the closed position by element 48. In addition, the inward movement of the door tends to push any items of rubbish which may be within the rubbish entrance portion B into the rubbish retaining portion A because the swinging of the door is only upward and away from the rubbish retaining portion and never initially downwardly towards the rubbish retaining portion and then upwardly therefrom, as is common in many prior art receptacles wherein the door retaining walls are mounted at an incline instead of vertically.

In addition, it should be noted that the doors 42 and 44 are substantially the full length of the rubbish entrance portion B and almost as long as the rubbish retaining portion A such that more rubbish and rubbish of larger size can be easily deposited in the receptacle of the present invention. Furthermore, surfaces 38 and 40, which form the top of rubbish entrance portion B, are inclined such that any rubbish which may be placed on top of the receptacle will, due to the force of gravity, slide off the rubbish entrance portion thereof.

Thus, the rubbish receptacle of the present invention is of relatively simple and sturdy construction which, when nearly full, prevents rubbish from exiting one door while additional rubbish is placed in the other door. In addition, the opening of one door will not push rubbish out the other door but instead tends to pack the rubbish into the rubbish retaining portion. Further, means are provided for retaining the doors in the closed position and for limiting the inward movement thereof. The doors, when in the closed position, provide a relatively effective seal tending to extinguish any fires which may take place within the receptacle. Still further, the rubbish receptacle has a large entrance door which permits the insertion of larger items of rubbish and greater quantities of rubbish and is provided with an inclined surface at the top thereof to prevent the placement of rubbish on the top of the receptacle.

While only a single embodiment of the present invention is disclosed herein for purposes of illustration, it is obvious that many variations and modifications may be made thereto. It is intended to cover all of these variations and modifications which fall within the scope of the invention as defined by the annexed claims.

What is claimed is:

1. A receptacle comprising a housing adapted to receive rubbish or the like, said housing having a rubbish receiving portion and a rubbish retaining portion, said rubbish containing portion comprising a box-like enclosure with an opening on the top surface thereof, the periphery of said opening being substantially smaller than the periphery of said top surface of said enclosure, said rubbish receiving portion comprising a plurality of walls, at least two of which are substantially upstanding with respect to said top surface, the lower portions of said walls being mounted on the top surface of said enclosure at the peripheries of said opening so that a portion of said top surface forms a ledge surrounding said rubbish receiving portion, one of said upstanding walls having an aperture, a door articulately mounted on said one wall and movable between a substantially vertical position, such that said aperture is closed, and a non-vertical position within said rubbish receiving portion exposing said aperture, means for limiting the inward movement of said door to said non-vertical position and for biasing said door towards said vertical position and means for preventing door movement outwardly of said rubbish receiving portion relative to said wall beyond said vertical position, said movement limiting and biasing means and said movement preventing means cooperating to prevent the former from impeding the free flow of rubbish through said aperture and into said opening.

2. The receptacle of claim 1 wherein said movement limiting and biasing means comprises an element mounted on said door, extending into said rubbish receiving portion and so position with respect to said door and said rubbish receiving portion as, when said door is in said non-vertical position, to engage a portion of the interior of said rubbish receiving portion and prevent movement of said door beyond said non-vertical position, and when said door is in any of its said positions, to bias said door towards said vertical position.

3. The receptacle of claim 2, in which said element extends inwardly from the upper portion of said door.

4. The container of claim 3, in which said door is pivotally mounted on said wall at an exis, and in which said element extends inwardly from said door adjacent said pivot.

5. The container of claim 2, in which said door is pivotally mounted on said wall at an axis, and in which said element extends inwardly from said door adjacent said pivot.

6. The receptacle of claim 5, in which said element, when said door is in said second position, engages a downwardly facing inner surface of said container.

7. The receptacle of claim 2, in which said element, when said door is in said second position, engages a downwardly facing inner surface of said rubbish receiving portion.

8. The receptacle of claim 7, in which said element, when said door is in said second position, engages a downwardly facing inner surface of said container.

9. The receptacle of claim 2, in which said housing comprises a top wall, and in which said element, when said door is in said second position, engages the inner surface of said top wall.

10. In the receptacle of claim 2, cooperating positive stop means on said door and said wall, respectively, and effective, when engaged, to fix said door position.

11. The receptacle of claim 10, in which said element extends inwardly from the upper portion of said door.

12. The receptacle of claim 1, further comprising a second door mounted to said housing independently of said first door, each of said doors being oriented in a substantially vertical position when closed.

13. The receptacle of claim 1 wherein said door is substantially the same length as the wall to which it is mounted.

14. The receptacle of claim 1 wherein said movement preventing means comprises cooperating positive stop means on said door and said wall, respectively, which are effective, when engaged, to prevent the outward movement of said door beyond said wall, and, in addition, to substantially seal said aperture when said door is in said vertical position.

15. The receptacle of claim 14 wherein said rubbish receiving portion is permanently affixed to said rubbish containing portion.

* * * * *